United States Patent [19]

London, Jr. et al.

[11] 4,004,329

[45] Jan. 25, 1977

[54] YARN INTERLACING AIR JET

[75] Inventors: Joe F. London, Jr., Greensboro, N.C.; Jean-Louis Lauber, Munchenstein, Switzerland

[73] Assignee: Burlington Industries, Inc., Greensboro, N.C.

[22] Filed: Sept. 18, 1975

[21] Appl. No.: 614,660

Related U.S. Application Data

[63] Continuation of Ser. No. 421,850, Dec. 5, 1973, Pat. No. 3,911,655, which is a continuation of Ser. No. 217,059, Jan. 11, 1972, abandoned.

[52] U.S. Cl. ..... 28/1.4

[51] Int. Cl.[2] ..... D02G 1/16

[58] Field of Search ..... 28/1.4, 72.12; 57/34 HS, 34 B, 140 J, 157 TS, 157 F, 140 R

[56] References Cited

UNITED STATES PATENTS

| | | | |
|---|---|---|---|
| 2,938,256 | 5/1960 | Bauer et al. | 28/1.4 |
| 3,251,181 | 5/1966 | Breen et al. | 28/72.12 X |
| 3,279,024 | 10/1966 | Sakai et al. | 28/1.4 |
| 3,678,549 | 7/1972 | Buzano | 28/72.12 |

*Primary Examiner*—Louis K. Rimrodt
*Attorney, Agent, or Firm*—Cushman, Darby & Cushman

[57] ABSTRACT

The present invention provides an apparatus for forming a textured air jet yarn by passing a yarn through texturing means whereby the yarn is false twisted and heat set in the twisted condition, passing the textured yarn through an air jet where the air is fed into the yarn at an angle of 45°–75° and passed cocurrently through the jet with the yarn to interlace the yarn and then collecting the textured, interlaced yarn.

3 Claims, 4 Drawing Figures

Fig. 1
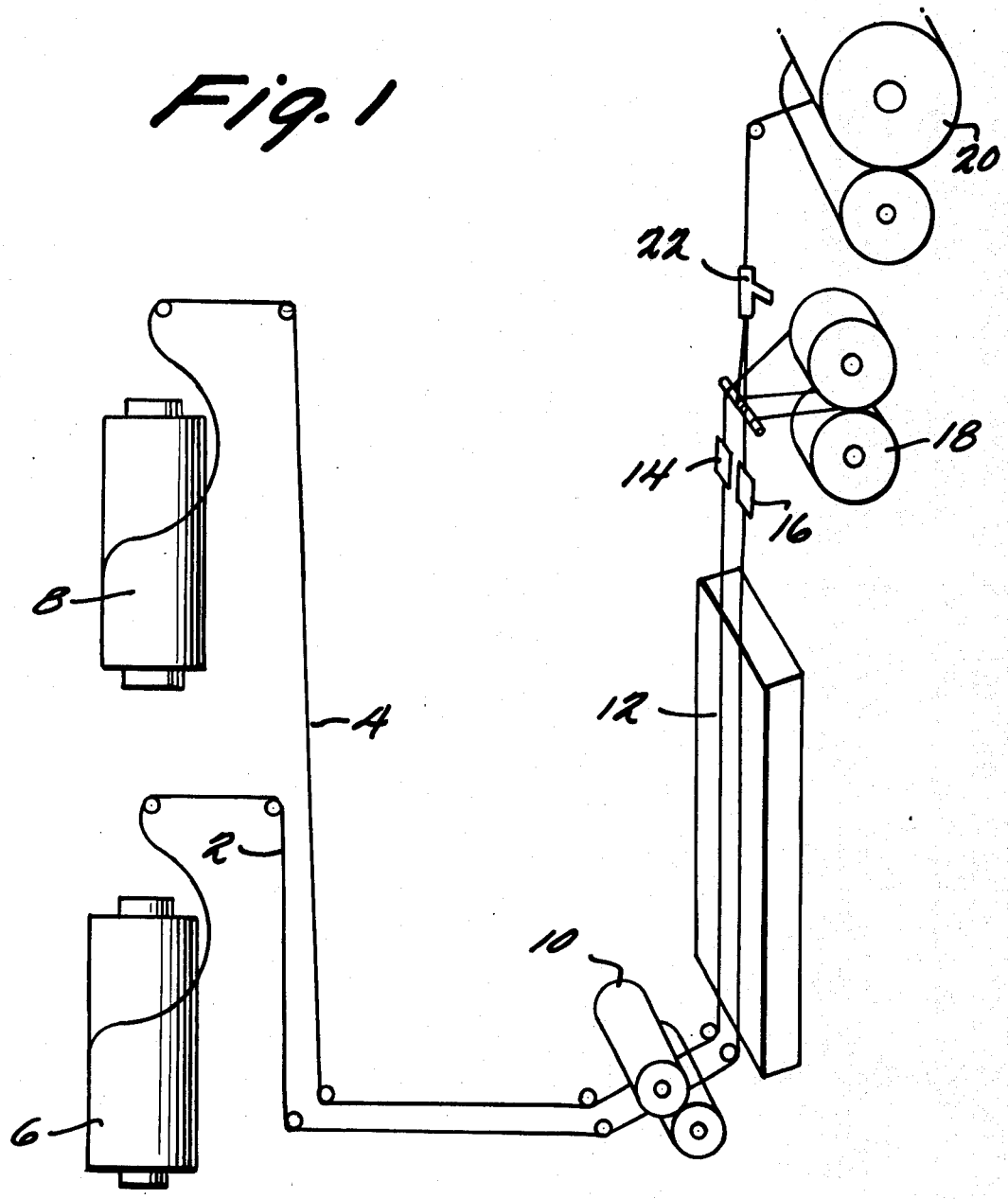
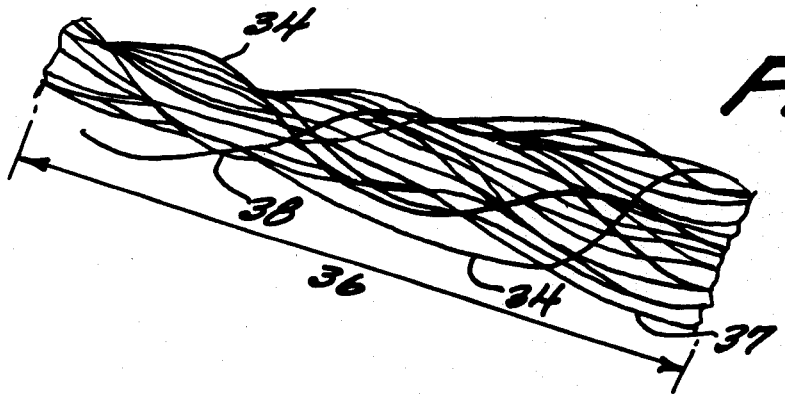
Fig. 4

YARN INTERLACING AIR JET

This is a continuation of application Ser. No. 421,850, filed Dec. 5, 1973, now U.S. Pat. No. 3,911,655, granted Oct. 14, 1975, as a continuation of Ser. No. 217,059, filed January 11, 1972, now abandoned.

The present invention relates to a textured yarn and process for making same. More particularly, the invention is concerned with the provision of textured yarn having improved pick resistance and processability.

Textured yarns composed of, for example, polyester, nylon and/or acetates, have found widespread use in woven and knitted fabrics, including double knit fabrics which are becoming increasingly important. While textured yarns are uniquely useful, a persistent problem with such yarns is that fabric made therefrom tends to suffer from filament picking or snagging when made from textured continuous filament yarns which have little or no twist therein. This problem can be overcome if the yarns are twisted to a relatively high level to produce a fairly tight bundle but this is usually undesirable because it is very costly and because the twisting of filament yarn produces a very hard yarn which in the case of textured yarn, completely destroys the textured appearance of the yarn and its desired bulk and loft, thus making the yarns unattractive for apparel fabric uses. Thus, it is evident that there is a real need in the art to provide textured yarns which retain their desired characteristics of bulk and loft while at the same time having a high resistance to picking or snagging.

Another area where the use of textured yarns can be improved is in the production of fabrics having a heather appearance. In recent years, it has become increasingly popular to use combinations of two cross-dyeable or different colored textured yarns to produce a heather look in knit or woven fabrics. Conventionally, this has been accomplished by plying the yarn ends together on a conventional twister before knitting or weaving. However, this is an expensive and relatively complicated operation and there is, therefore, considerable room for improvement here towards providing combinations of cross-dyeable or different colored textured yarns for use in making fabrics having a heather appearance.

In keeping with the above, one of the principal objects of the present invention is to provide textured yarns and fabrics containing the same which demonstrate improved resistance to picking and snagging. Another object of the invention is to provide a process for making such textured yarns.

An additional object of the invention is to provide textured yarns which are highly desirable for use in producing fabrics having a heather appearance and a method for making such yarns which is much more convenient and economical than procedures hitherto used.

Other objects will also be apparent from the following detailed description of the invention.

Broadly speaking, the objects of the invention are realized by moving one or more textured multifilament synthetic yarns through an air jet flowing cocurrently with the direction of yarn movement and introduced into the yarn at an angle of about 45°–75° so that the filaments in the textured yarn are uniformly intermingled and entangled before the yarn is taken up. Preferably, but not necessarily, the jet treatment is combined with texturing of the yarn, e.g. the yarn is passed continuously through a conventional false-twist texturing machine and subjected to the action of the jet between texturing and the take-up of the texturing machine.

The jet causes the filaments of the textured yarn to become periodically entangled or wound together along the length of the yarn so that there are no substantial lengths of the yarn where individual filaments are free to slip and thus be receptive to picking. One or more textured multifilament yarns may be subjected to the air jet treatment, it being appreciated that two or more of such yarns which are cross-dyeable or different colored can be so processed to give a combination yarn suitable for providing heather effects.

The yarn of the invention can be more fully described as an air jet intermingled or interlaced textured yarn comprising a plurality of continuous synthetic thermoplastic filaments, the yarn being further characterized by relatively uniform repeating sections of about ⅛-inch in length, each such section being composed of a relatively open portion of bulky and lofty false-twisted multifilaments and a relatively short node portion where the multifilaments are brought closer together and are interlaced and encircled.

The success of the invention is due to a number of important features. For one thing, it has been found that relatively frequent and uniformly occurring nodes or interlacing in repeating yarn sections as defined above, are important from the standpoint of pick resistance. In past uses of air jets for mingling textured yarns, nodes or interlacings have been kept to a minimum and thus the resulting products have not offered particularly improved pick resistance.

Additionally, it is important for present purposes to use the indicative combination of false-twist texturing and air jet interlacing since the desired bulky and lofty textured product with optimum pick resistance cannot be obtained if the texturing or air jet is used alone.

It is also important to the success of the invention that the jet flow be cocurrent with the yarn direction rather than counter-current thereto and it is preferred that the jet have a stepped air/yarn passage. Air pressure and degree of yarn overfeed are also important as is the angle at which the air is mixed with the yarn. Other important features will also be evident hereinafter.

The invention is more fully described in conjunction with the attached drawings wherein FIG. 1 is a diagrammatic view of a false-twist texturing machine including the air jet yarn interlacing feature of the invention;

FIG. 4 is a perspective view of the interlaced textured yarn of the invention.

Figure 2:
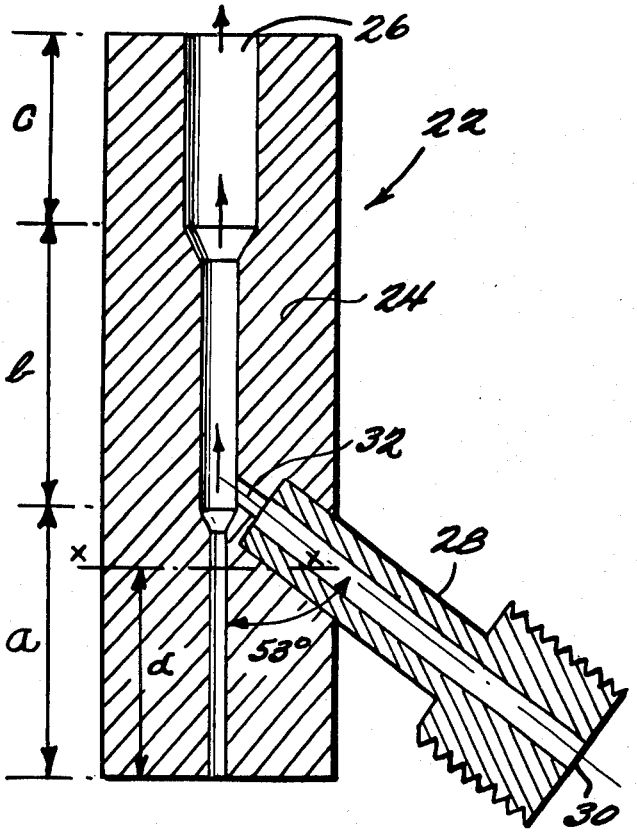
FIG. 2 is a vertical sectional view through a preferred form of air jet according to the invention.

Referring more specifically to FIG. 1, which shows a texturing machine for simultaneously and separately texturing two yarns, 2 and 4 are fed into the machine from supply packages 6 and 8 by pulling the yarns over the ends of the packages into the bottom rolls 10 of the texturing machine. As will be understood, the bottom rolls 10 may be rotated at a speed such as to overfeed or underfeed the yarns into the heater 12 of the texturing machine.

Each of the yarns passes from the heater 12, which may be of any conventional type (e.g. an electrically heated contact surface), through its own false twist spindle 14 and 16, one of which imparts a Z torque and the other an S torque. As known in the art, the twist applied by spindles 14 and 16 extends downwardly to heater 12 where the twist is heat set as in a conventional texturing operation.

The yarns are pulled from the spindles by a pair of feed rolls 18 which can either feed the yarns to a second heater (not shown) for relaxation or directly to the take-up rolls 20. On a double heater machine, the feed rolls 18 feed the yarns through the second heater with overfeeds which are standard in false-twist texturing and a third set of feed rolls pulls the yarn out of the second heater and feeds it onto the take-up package. As indicated, FIG. 1 does not show the double heater arrangement but this is not essential for present purposes. According to the invention, the textured yarns resulting from the false-twist heat-setting operation are fed either directly or indirectly from rolls 18 to take-up rolls 20 via an interlacing air jet 22 which interlaces and entangles the textured yarns just before they are taken up on rolls 20.

The preferred structure for air jet 22 is more fully shown in FIG. 2. Basically the jet comprises a body 24, advantageously tubular, of steel or other metal having a stepped tubular passage or bore 26 running lengthwise thereof, the yarn or yarns and air flow passing through passage 26 in the direction of the arrows. The lengths and diameters of the several stepped bores or bore sections *a*, *b* and *c* of the passage may be varied although section *b*, which is where the air is introduced, should be at least as long as, and preferably longer than the other two sections. In one embodiment shown in FIG. 2, section *b* is about 10% longer than section *a*, the yarn inlet section, and about 50% longer than section *c*, the discharge section. These length relationships, however, can be varied although for best overall results it is desirable to maintain the stepped feature comprising three sections of diameter increasing from the yarn inlet to the outlet. Advantageously, the yarn inlet section *a* has the smallest diameter, the intermediate section *b*, where the air is introduced, has a diameter from 1.5–3 times larger than that of section *a* and the diameter of discharge section *c* is about 1.5–2 times larger than that of section *b* although it will be recognized that other diameter relationships may also be used. In any case, the diameter changes should be made gradually by tapering the passage outwardly as shown to avoid undesired turbulence.

Air is introduced into section *b* of the jet through member 28 which is provided with an air inlet passage 30 positioned at an angle of 45°–75°, preferably at about a 53° angle to the yarn as shown in FIG. 2. Obviously the outer diameter of the body 24 may be widely varied but a preferred dimension is one wherein a straight line *x—x* drawn across the body 24 from the center of the air passage 30 defines a length *d* which is about 75–90% of the length of passage *a*.

As shown in FIG. 2, passage 30 is reduced in diameter (usually by about two-thirds – three-fourths) as shown at 32 and discharges air into the yarn in section *b* just beyond the point where section *b* begins. When the air flow through 32 meets the yarn flow in section *b*, the filaments of the yarn or yarns are moved about in such a manner that they are interlaced and entangled into nodes at very short and regular intervals. The internodal distance is of the order of ⅛ to 1 inch, preferably ¼ to ½ inch although it will be recognized that this distance can be varied. It is important, to avoid excessive winding and twisting, that the air stream contact the yarn at essentially the exact center of the yarn.

Figure 3:
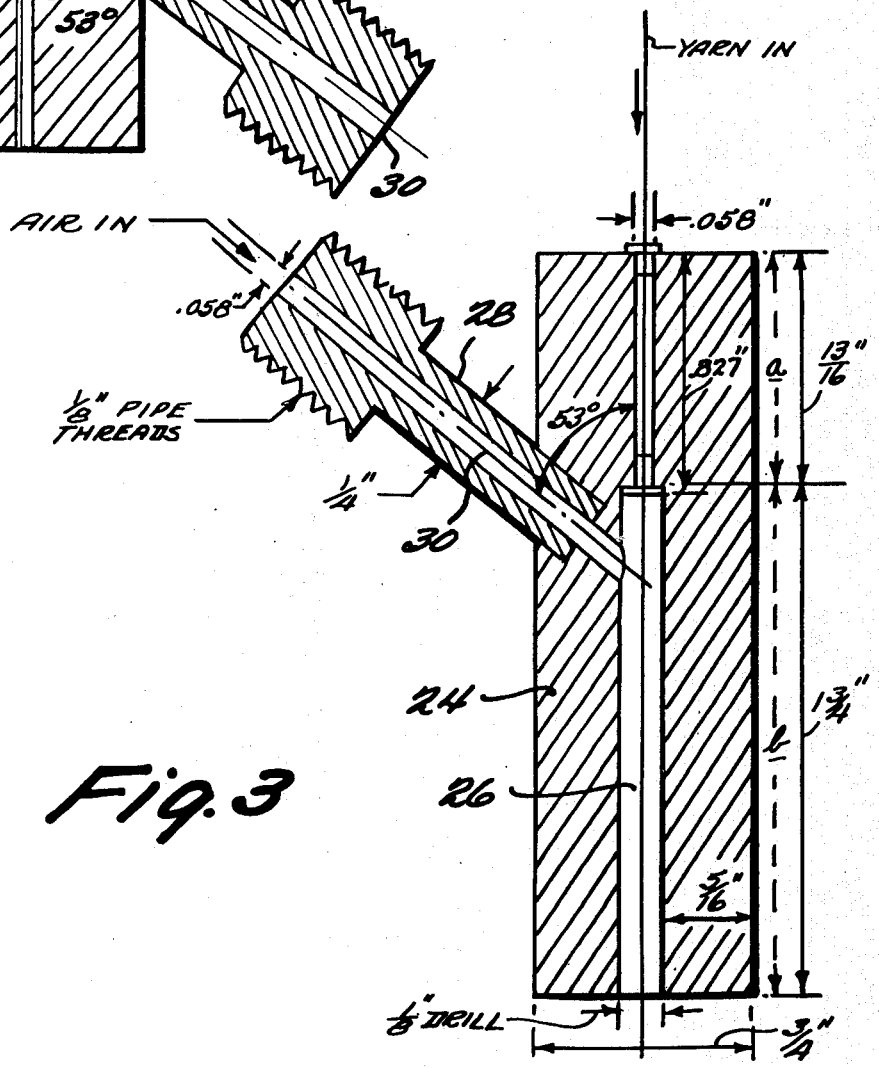
FIG. 3 is a vertical sectional view of another simpler form of air jet which is suitable for use herein.

FIG. 3 shows a simplified jet for use herein, the same numerals being used in FIGS. 2 and 3 to define like parts. In the embodiment of FIG. 3, the diameter of the yarn passage 26 is changed only once from a relatively narrow inlet bore portion *a* to an intermingling portion *b* and the air passage 30 is of uniform diameter throughout. A preferred set of dimensions is given in FIG. 3.

The air pressure used in jet 22 has an effect on the degree of interlacing, blending and quality of the ultimate product. The optimum air pressure will depend on the nature of the yarn or yarns utilized but it appears that for best overall results an air pressure in the range of about 15–30 psig should be used for the jet structure shown in FIG. 2. Pressures in this range give good yarn quality and sufficient entanglement and interlacing to give a product offering outstanding pick resistance. High pressures, e.g. 25–30 psig can be used in certain circumstances but the yarn may begin to look hairy and abnormal due to tight entanglement of the filaments and the best overall yarn quality seems to be realized at the indicated 15–30 psig range.

Another important variable is the degree of overfeed of the yarn into the jet. It is important to balance the overfeed at this point with the overfeed required to wind up the textured package. Too much overfeed into the jet gives excessive yarn turbulence which will form undesired loops in the jet. An overfeed of from 2% to 10% into the jet has been found very satisfactory. Below this degree of overfeed, interlacing efficiency appears to be reduced whereas above 6–8% there is some tendency to get looping of the filaments and yarn entanglements which do not give a uniform product although under other conditions, overfeeds may be increased further.

The invention has been described above and illustrated in FIG. 1 using a false-twist texturing apparatus comprising spindles for applying both S-and Z-torque. This type of apparatus is well known and particularly convenient for use herein although any conventional type of texturing apparatus may be used herein to include the air jet feature for preparing intermingled textured yarn. The S and Z arrangement illustrated in FIG. 1 has the advantage that two yarns 2 and 4 can be processed separately until the last feed roll (roll 18 in FIG. 1) where they are combined and fed to the jet together to be interlaced and thus form one individual yarn which has zero torque due to an equal combination of S-torque and Z—torque in individual filaments, thereby eliminating the need for post-heat setting or ply-twisting to control torque levels.

It is not essential for present purposes to continuously texture and intermingle as illustrated in FIG. 1. For example, the yarn may be pre-textured and then subjected to the air jet in two separate or discontinuous operations.

It will be appreciated that the arrangement of FIG. 1 lends itself to a number of useful variations. Thus, in a particularly important embodiment, a single end of multifilament yarn can be textured, the filaments of the single end being intermingled in the jet 22 using the arrangement of FIG. 2 to give a yarn which is uniquely useful in preparing pick resistant knit fabrics. In another important variation, a zero torque yarn can be prepared by combining S and Z yarn of equal degree of torque as indicated above. As a further alternative, two or more different colored or differently dyeable yarns may be separately false-twisted and then combined at the jet before going onto the take-up package. This eliminates the need for ply-twisting different yarns to form heather yarns and produces a more intimate blend of colors at a much reduced processing cost.

The improved pick resistance of fabrics made with intermingled textured yarn according to the invention is effectively shown by the Mace snagging test or tester described below. Thus, for example, conventional 150-denier textured multifilament polyester yarn (not interlaced) knit in a Swiss pique fabric shows a pick resistance grading of 3 to 2 when tested on the Mace snagging test whereas identical yarn which has been interlaced according to the invention at 15 psig on a conventional Scragg texturing machine gives a pick resistance of 5 to 4 rating for double knit fabric. This is a very significant improvement since 5 is considered excellent while 3 is borderline acceptable.

The snag or pick ratings cited herein were determined on a one-position Model B-612 Mace Snag Tester, manufactured by ABC Machinery Corporation, Charlotte, N.C., based on the specifications of the Mace Snag Tester of ICI Fibres Limited. The ICI instrument, discussed in Textile Industries, December, 1970, pages 125–6, is described in detail in the "Provisional Handbook for MK 2 'Mace' Snag Tester and Viewing Cabinet," by W. A. Shepherd, Textile Development Department, ICI Fibres Limited, Hookstone Road, Harrogate, Yorks, England. Test specimens were compared with ICI photographic standards, reference number DGH 1922, having ratings from 1 to 5, with intermediate numbers 4–3, 5–4, etc., 5 indicating zero snags. Only the number, not the type, of snags or picks was evaluated. Ratings cited are the average of two measurements per direction, wale and course, with tests re-run whenever paired ratings were more than one unit apart. The precision of the mace test, 95% confidence, is ±0.5 units.

The invention is useful with any type of continuous multifilament synthetic yarn which is normally textured, e.g. polyester, nylon, acetate, acrylic or the equivalent, or combinations thereof, in either the same or separate yarns. Representative of such yarns is 2/70 denier, 68 filament polyester yarn or 150 denier, 34 filament polyester yarn.

A wide variety of fabric constructions may be made with the yarns of the invention to give the indicated pick resistance and/or heather effect, e.g. double knits.

The interlaced textured yarn of the invention as shown in FIG. 4 comprises a plurality of continuous synthetic thermoplastic filaments 34, the yarn being further characterized by relatively uniform repeating sections 36 of about ⅛ – 1 inch in length, each said section being composed of a relatively open portion 37 of bulky and lofty false-twisted multifilaments and a relatively short node portion 38 where the multifilaments are brought closer together and are interlaced or encircled.

While the invention has been described above with particular reference to providing improved pick resistance, or heather effects, it should be noted that the intermingled textured yarns of the invention also provide other advantages in weaving and knitting fabric therefrom. Thus, for example, the intermingled or mechanically bonded filaments prepared herein are particularly advantageous for use in warp knitting and weaving where warping is necessary. A major problem in warping is caused by loose or flaring filaments from a yarn bundle since most textured yarns are very open or twistless. However, when these yarns are interlaced periodically along the length of the yarn after texturing according to the invention, flaring filaments and loose filament bundles are eliminated or controlled and greater efficiency in knitting and warping is obtained.

The invention is illustrated by the following examples:

EXAMPLE 1

Textured yarns of 70/34 Z-torque white and 70/34 S-torque black nylon, each having one-fourth turn per inch of producer twist, were fed together through an interlacing apparatus designed to provide controlled overfeeding between the overfeed rolls to the winder. The stepped jet of FIG. 2 (outside diameter (e) 0.785 inch; bore *a* 0.870-inch length, 0.0595-inch diameter, No. 53 drill; bore *b* 0.953-inch length, 0.1285-inch diameter, No. 30 drill; bore *c* 0.647-inch length, 0.1960-inch diameter, No. 9 drill; length *d* 0.7375 inch) was set between the two pairs of rolls to interlace the two yarns. The interlaced yarn was wound onto a constant-tension take-up. The yarns were interlaced in successive runs at eight inlet air pressures ranging from 5 to 40 psig, at overfeeds of 1%. The resulting interlaced yarns were visually rated, relative to each other, on a 1-to-8 scale, in terms of degree of blending (judged by color uniformity), degree of interlacing, and overall appearance. When the results were plotted against the pressure, it was evident that blending and interlacing reached a maximum at about 20–25 pounds. Yarn appearance, after improving up to about 20 pounds, decreased drastically with further increase in pressure. The decrease was attributed to the onset of excessive interlacing and knotting. A similar tabulation of runs where pressure was held at 20 psig while the overfeed was varied from zero to 4% led to the conclusion that an overfeed of about 2% was optimum for this yarn. In general it is believed that overfeed should be as high as can be tolerated, short of looping the filaments, to provide maximum opportunity for interlacing. Subsequent tests showed that higher overfeeds and pressures were required as the denier-per-filament size of the yarns increased.

A similar set of runs using the jet of FIG. 3 produced no perceptible differences in the results. It was concluded that although the enlarged exit of the FIG. 2 jet did not visibly affect that quality of the output yarn, compared with the FIG. 3 jet, it did both quiet the noise of the jet and make it easier to align the drilling of the interlacing chamber and the final placement of the jet. The FIG. 2 jet was accordingly used in the subsequent examples.

EXAMPLE 2

Textured yarns of S-torque 70/34 Type 56 standard disperse-dyeable Dacron polyester and Z-torque 70/34 Type 92 acid-dyeable Dacron polyester were drawn from packages through the stepped jet of Example 1, using conditions of 20 psig air pressure, 2% overfeed, and 150 ypm throughput. Both processing smoothness and product uniformity were good; and the output yarn, when converted to a single-knit jersey and dyed with an acid dye, produced a pleasing heather effect. The appearance contrasted most favorably with the same jersey made from a two-color plied yarn, which latter, because of a strong tendency to an erratic patterning, produced an irregularly barred and twill-like effect.

EXAMPLE 3

Textured yarns of 70/17 S-torque Type 56 and Z-torque Type 92 Dacron were successfully interlaced by the procedure of Example 1 by increasing the air pressure of the stepped jet to 28 psig and the overfeed to 3%. It was evident that the yarn composition, particularly its denier per filament, was a significant factor in determining the optimum operating conditions for applying this invention.

EXAMPLE 4

Six of the stepped jets of Example 1 were installed above the top feed rolls of twelve positions of a Scragg Model CS-12 single-heater texturing machine, equipped to texture with S- and Z-torque on alternate positions, as shown in FIG. 1. Each pair of feed yarns of 70/34 Type 92 and 70/34 Type 56 Dacron were textured with S- and Z-torque, respectively, and then passed together through a jet for interlacing, at 15 psig air pressure and 6% overfeed to the package, the overfeed being increased over earlier examples to give a good package, and the pressure reduced to prevent knotting. The yarn thus produced, showing nodes at 3/8-inch intervals, was knitted into a double-knit fabric for comparision, after dyeing, with a control fabric of identical structure except that the latter fabric was made from a 150/34 Type 56 Dacron, textured and set but not interlaced. Both fabrics were tested for pick resistance on the Mace Snag Tester. The interlaced fabric had a nearperfect snag rating of 5–4, measured both length- and widthwise, while the other fabric had a borderline rating of 3–2 lengthwise and a low rating of 2 widthwise. Double-knit fabrics in a much looser Swiss-pique stitch from the same yarns had even more pronounced differences in pick resistance which, though slightly lower than before for both fabrics, further accented the pickresistant merit of the fabrics of the invention. They had the additional advantage of an attractive heather effect when dyed. Their pick-resistance ratings are shown in Table 1.

Table 1

Mace Test Ratings of Loose-Knit Fabrics from Interlaced and Non-interlaced Yarns

| Yarn Type | Fabric Side | Mace Rating Length | Mace Rating Width |
|---|---|---|---|
| Interlaced | Face | 3–2 | 5–4 |
| Non-interlaced | Face | 1 | 3 |

Table 1-continued

Mace Test Ratings of Loose-Knit Fabrics from Interlaced and Non-interlaced Yarns

| Yarn Type | Fabric Side | Mace Rating Length | Mace Rating Width |
|---|---|---|---|
| Interlaced | Back | 4 | 5–4 |
| Non-interlaced | Back | 4–3 | 3 |

EXAMPLE 5

In this example of 150/34 Type 56 Dacron was drawn from a supply package through a single-heater Model CS-12 Scragg texturing machine and thence through the stepped jet of Example 1. The yarn did not interlace well until the air pressure was increased to 24 psig and the overfeed to the supply package to 8%. This example further shows the close relationship existing among the variables of filament denier, air pressure, and overfeed.

EXAMPLE 6

The effects of variations in the stepped jet of Example 1 upon the entangling behavior of 150/34 Type 56 Dacron yarn are described in this example. Dimensions were as shown in Example 1 except where otherwise stated. Changes were made in the inlet air pressure of the jet, the angle of air impact upon the yarn, and the diameter of the interlacing chamber, as detailed in Table 2. Letter references (*b*) and (*d*) in the table are to the corresponding designations in FIG. 2. The yarn was fed through the first and middle rolls of an ARCT FTF double-heater machine (heaters at 200° and 210° C., respectively) at 73 meters/minutes, through the top rolls at 63.5 meters/minute, through the jet, and thence onto the takeup package at 64.1 meters/minute. The interlacing characteristics of the yarns produced by each jet are described in Table 3.

TABLE 2

Variations in Dimensions of Interlacing Jets

| Jet No. | Inlet Angle Degrees | Inlet Entry Point, (d) Inches | Interlacing Chamber Diameter, (b) Inches Drill Size |
|---|---|---|---|
| 1 | 53 | 0.7375 | 0.1285 (No. 30) |
| 2 | 53 | 0.8375 | 0.1285 (No. 30) |
| 3 | 38 | 0.5305 | 0.1285 (No. 30) |
| 4 | 68 | 0.8735 | 0.1285 (No. 30) |
| 5 | 53 | 0.7375 | 0.0980 (No. 40) |
| 6 | 53 | 0.7375 | 0.1610 (No. 20) |

TABLE 3

Characteristics of 150/34 Type 56 Dacron Yarn Interlaced in Jets of Table 2

| Jet No. | Air Pressure 16 psig | Air Pressure 22 psig | Air Pressure 28 psig |
|---|---|---|---|
| 1 | Interlacing fair; nodes ⅜" apart | Interlacing good; nodes ⅜" apart | Interlacing good; nodes ⅜" apart; some loops |
| 2 | Interlacing fair; nodes ⅜" apart | Interlacing good; nodes ⅜" apart | Interlacing good; nodes ⅜" apart; some loops |
| 3 | Interlacing very poor | Interlacing poor; nodes widely separated | Interlacing poor; nodes about ½ to ⅝" apart |
| 4 | Interlacing good; nodes ¼" apart | Interlacing better than at 16 psig; nodes ¼" apart | Interlacing better than at 22 psig; nodes ¼" apart |
| 5 | Interlacing poor; nodes ¼" apart | Interlacing poor; nodes ¼" apart | Interlacing fairly good; nodes ¼" apart; some loops |
| 6 | Interlacing poor | Interlacing fair | Interlacing fairly good; nodes about ½" apart; some loops |

From these results it is apparent, with this yarn, that an air inlet angle centered around 53° seems optimum, that increasing the angle decreases the distance between the nodes, that decreasing the angle increases the distance between the nodes and soon seriously decreases the entangling, that minor changes in the location of the gas inlet port have no detectable effect, and that variations, whether up or down, in the diameter of the interlacing chamber from a value around one-eighth inch soon become harmful to the interlacing process. It had earlier been recognized that precise alignment of the inlet tube to assure that the air would strike the yarn dead-center in the interlacing tube was imperative, to avoid undesirable twisting caused by rotation of the yarn bundle.

The frequency of the nodes seems to be a function of both the diameter of the interlacing chamber and the air inlet angle, the sensitivity to minor changes in either of these parameters being fairly great. As the inlet angle rises above 53°, both the length and frequency of the nodes tend to increase. This has the effect of simultaneously increasing the pick resistance, but caution must be taken not to go too far. Otherwise, excessive loss of loft and covering power in the yarn and the fabrics made from it may occur.

It seems, further, that too small an interlacing chamber diameter confines the yarn excessively, while too large a chamber permits it to move about more freely than is desirable, either effect being harmful to the yarn properties.

On the whole it appears that for this yarn an inlet angle of 53°, an interlacing chamber diameter of about one-eigth inch, and an inlet air pressure of 22 psig are the optimum operating conditions. Best conditions for other yarns will differ from these to some degree, but it is well within the skill of the art to determine such conditions by simple experimentation following the teachings of this invention.

EXAMPLE 7

An attempt was made to turn the jet of Example 1 around so that the air, at 22 psig, flowed countercurrent to the 150/34 Type 56 Dacron yarn. The same yarn speed conditions were applied as in Example 6, except that, to avoid lap-ups caused by the excessive overfeed, the take-up rate had to be increased to 67.9 meters/minute. The resulting yarn had only a small amount of interlacing, the nodes being infrequent and easily pulled out upon extending the yarn slightly. The combination of low overfeed and limited interlacing thus resulted in excessive loss of both covering power and pick resistance. It was concluded from this experiment that the pick-resistant yarn of this invention could be obtained only by using a cocurrent-flow jet.

EXAMPLE 8

In this example a comparison was made between the pick resistance of fabrics made from a textured interlaced yarn of this invention and a twisted yarn. The interlaced yarn was the 150/34 Type 56 Dacron of Example 5, while the twisted yarn was made by plying two ends of textured 100/34 Type 56 Dacron having 6 turns of Z twist. The interlaced yarn was knitted into a 6.10-g/yd² Swiss-pigue and the other into a 9.37-g/yd² Swiss-pique, and the fabrics were submitted to the Mace test. Results are summarized in Table 4.

Table 4

Mace Test Ratings of Fabrics from Interlaced and Twisted Yarns

| Yarn Type | Fabric Side | Mace Rating Length | Mace Rating Width |
|---|---|---|---|
| Interlaced | Face | 4 | 3 |
| Twisted | Face | 4–3 | 3 |
| Interlaced | Back | 5–4 | 5–4 |
| Twisted | Back | 5–4 | 4–3 |

Especially taking into account that the fabric from the twisted yarn had the advantages of both a higher-denier yarn and a heavier-weight fabric, each of which should improve the pick resistance, it is believed that these results indicate that the interlaced yarn is equal or perhaps even superior to the twisted yarn.

EXAMPLE 9

Five samples of 150/34 Type 56 Dacron yarn were textured, two on the Scragg CS-12 single-heater machine and three on the ARCT FTF double-heater machine, for a carefully controlled comparison of interlaced with non-interlaced yarns. Preparations of samples 1 and 2, textured on the Scragg and then autoclaved at 230° F., differed only in that a stepped jet of Example 1 was operated, at 24 psig, above the final feed roll of sample 2, but not of control sample 1. Operating conditions were:

| | |
|---|---|
| Bottom overfeed | +1% |
| Top Overfeed | +8% |
| Heater temperature | 200° C. |
| Twist | 63 tpi |
| Yarn speed | 106 yds/min |

Samples 3,4 and 5 were textured on the ARCT FTF machine, with no jet with sample 3, an Example 1 jet a 22 psig with sample 4, and a 28 psig jet with sample 5, both jets being between the top roll and the take-up package. Operating conditions were:

| | |
|---|---|
| Bottom overfeed | 0% |
| Second overfeed | +13.7% |
| Top overfeed | −1.75% |
| Twist | 63 tpi |
| Yarn speed | 73 meters/min |
| Bottom heater temperature | 200° C |
| Top heater temperature | 210° C |

All five yarns were then knitted with a Ponte-diRoma stitch on an 18-cut machine, and the resulting fabrics were dyed a smoke-grey for easy observation of picks. Table 5 shows the results obtained on the mace tester.

Table 5

Mace Test Ratings of Knitted Fabrics from Yarns Made on Texturing Machines with and Without Integral Jets

| | Sample | Face Rating Length | Face Rating Width | Back Rating Length | Back Rating Width |
|---|---|---|---|---|---|
| 1 | (not interlaced) | 3 | 2 | 3 | 4 |
| 2 | (interlaced) | 5–4 | 4 | 4 | 5–4 |
| 3 | (not interlaced) | 4–3 | 4–3 | 4 | 3 |
| 4 | (interlaced) | 4 | 5–4 | 4 | 5–4 |
| 5 | (interlaced) | 4 | 4 | 4 | 5–4 |

These data show a pattern of significantly improved pick ratings of the interlaced-yarn fabrics over their noninterlaced controls. Comparison of Samples 4 and 5 indicates, on the ARCT machine and with the 150/34 Dacron yarn, that an air pressure of 22 psig was sufficient to provide maximum pick resistance and that there was no merit in applying the noisier and more expensive 28 psig air pressure.

Textile fabrics of improved pick-resistance obtained using the yarns of the present invention are the subject of a copending application Ser. No. 217,060, now U.S. Pat. 3,824,776 filed on even date herewith.

It will be appreciated from the foregoing that various modifications may be made in the invention as described above. Hence the scope of the invention is defined in the following claims wherein what is claimed as new is:

We claim:

1. An air jet device for use in interlacing textured yarn, said device comprising a body having a cylindrical chamber of about one-eighth inch diameter formed within said body for movement of yarn therethrough, a coaxial yarn feed passage of a diameter smaller than said chamber leading into said chamber, an air inlet of a cross-section smaller than that of said chamber and having an axis which converges with respect to the axis of the chamber in the direction of yarn movement through said chamber and intersecting therewith at an angle of between 45° and 75° measured between said inlet and said passage, means for supplying air under pressure to said inlet and means for supplying yarn to said coaxial yarn feed passage.

2. The device of claim 1 wherein said cylindrical chamber is in an intermediate section of the body, the yarn feed passage is in a yarn inlet end section of the body, and said body includes a coaxial larger cylindrical chamber formed in a yarn discharge end section thereof, the chamber in said intermediate section having a diameter from 1.5 – 3 times larger than that of the passage in said yarn inlet end section and the chamber in said discharge end section having a diameter of about 1.5 – 2 times larger than the diameter of the chamber in said intermediate section.

3. The device of claim 2 wherein the axis of said air inlet intersects the axis of said cylindrical chamber at an angle of substantially 53°.

* * * * *

UNITED STATES PATENT OFFICE
CERTIFICATE OF CORRECTION

Patent No. 4,004,329 Dated January 25, 1977

Inventor(s) Joe F. London, Jr. and Jean-Louis Lauber

It is certified that error appears in the above-identified patent and that said Letters Patent are hereby corrected as shown below:

Column 2, line 20, change "1/8"" to --1/8" - 1"-- .

Column 6, line 50, change "that" to --the-- .

Column 8, line 12, change "of" to --a-- .

line 34, change "minutes" to --minute-- .

Column 9, line 34, correct spelling of "one-eighth" .

line 66, change "pigue" to --pique-- .

Column 10, line 39, change "a" to --at-- .

Signed and Sealed this

Nineteenth Day of April 1977

[SEAL]

*Attest:*

RUTH C. MASON
*Attesting Officer*

C. MARSHALL DANN
*Commissioner of Patents and Trademarks*